US009527655B2

(12) United States Patent
Kaufman

(10) Patent No.: US 9,527,655 B2
(45) Date of Patent: Dec. 27, 2016

(54) SPRAY PAINT MARKING SYSTEM WITH LOCATING DISPENSER GUARD

(71) Applicant: Brett J Kaufman, Newburgh, IN (US)

(72) Inventor: Brett J Kaufman, Newburgh, IN (US)

(73) Assignee: Berry Plastics Corporation, Evansville, IN (US)

( * ) Notice: Subject to any disclaimer, the term of this patent is extended or adjusted under 35 U.S.C. 154(b) by 772 days.

(21) Appl. No.: 13/653,949

(22) Filed: Oct. 17, 2012

(65) Prior Publication Data

US 2013/0092759 A1 Apr. 18, 2013

Related U.S. Application Data

(60) Provisional application No. 61/548,117, filed on Oct. 17, 2011.

(51) Int. Cl.

| | |
|---|---|
| ***B65D 3/14*** | (2006.01) |
| ***B65D 83/20*** | (2006.01) |
| ***B65D 83/40*** | (2006.01) |

(52) U.S. Cl.

CPC ..... *B65D 83/203* (2013.01); *B65D 83/205* (2013.01); *B65D 83/40* (2013.01); *B65D 83/206* (2013.01)

(58) Field of Classification Search

CPC ..... B65D 83/40; B65D 83/203; B65D 83/205

USPC ..... 239/288, 288.3, 288.5; 222/174, 182, 222/402.1, 402.13, 165, 321.6, 325, 378; 220/724, 727

See application file for complete search history.

(56) References Cited

U.S. PATENT DOCUMENTS

| | | | | |
|---|---|---|---|---|
| 3,738,536 | A * | 6/1973 | Gach | B65D 83/40 215/220 |
| 3,760,988 | A * | 9/1973 | Ostrowsky | B65D 83/206 222/153.11 |
| 4,066,596 | A * | 1/1978 | Stern | 222/635 |
| 5,518,148 | A | 5/1996 | Smrt | |
| 6,112,933 | A | 9/2000 | Meyer et al. | |
| 6,551,001 | B2 * | 4/2003 | Aberegg | A01M 7/00 222/608 |
| 6,644,491 | B2 | 11/2003 | Dewig et al. | |
| 6,769,563 | B2 * | 8/2004 | Tumlin et al. | 220/284 |
| 6,886,708 | B2 | 5/2005 | Kaufman et al. | |
| 6,981,533 | B2 * | 1/2006 | Zorzo | B65D 83/203 141/18 |
| 7,308,993 | B2 * | 12/2007 | Mineau | 222/182 |
| 7,628,298 | B2 * | 12/2009 | Dewig | B65D 83/40 220/915 |
| 8,267,286 | B2 * | 9/2012 | Smrt et al. | 222/402.11 |
| 2006/0273061 | A1 * | 12/2006 | Fricke | B65D 51/24 215/228 |

* cited by examiner

*Primary Examiner* — Arthur O Hall
*Assistant Examiner* — Alexander Valvis
(74) *Attorney, Agent, or Firm* — Barnes & Thornburg LLP

(57) ABSTRACT

A marking wand includes a paint canister and a frame that receives the paint canister. The paint canister loads into a chamber provided at the bottom of the frame so that a dispenser of the paint canister faces downwardly toward the ground. Once the paint canister is loaded in the frame, a user can hold a handle at the top of the frame and pull a trigger included in the handle to actuate the dispenser by pushing the dispenser in a predetermined location thereby discharging paint from the paint canister and marking the ground.

16 Claims, 9 Drawing Sheets

SPRAY PAINT MARKING SYSTEM WITH LOCATING DISPENSER GUARD

PRIORITY CLAIM

This application claims priority under 35 U.S.C. §119(e) to U.S. Provisional Application Ser. No. 61/548,117, filed Oct. 17, 2011, which is expressly incorporated by reference herein.

BACKGROUND

The present disclosure relates to spray paint marking systems configured to dispense paint in a downward direction for ground or surface marking. In particular, the present disclosure is directed to spray paint marking systems including paint canisters containing paint that are used in conjunction with a marking wand to dispense paint onto the ground or a surface.

SUMMARY

According to the present disclosure, a marking wand is used to mark lines of paint on the ground. The marking wand includes a paint canister and a frame that receives the paint canister. The paint canister loads into a chamber provided at the bottom of the frame so that a discharge outlet of the paint canister faces downwardly toward the ground. Once the paint canister is loaded in the frame, a user can hold a handle at the top of the frame and pull a trigger included in the handle to discharge paint from the paint canister and mark a line on the ground.

In illustrative embodiments, the paint canister includes a tapered container for holding paint and a dispenser for discharging paint from the tapered container. The tapered container is formed from a cylindrical side wall and a dome wall that tapers in from the cylindrical side wall to a container opening. A marking dispenser guard is provided to mount on the tapered container so that the paint canister is located properly in the chamber of the frame and the marking wand is able to dispense paint from the tapered container.

The dispenser guard includes a dispenser-locator shoulder that locates the dispenser of the paint canister properly in the chamber of the frame when the paint canister is loaded in the frame. The dispenser-locator shoulder is spaced apart from the tapered container and is supported by a shell included in the dispenser guard. The shell of the dispenser guard is coupled permanently to the tapered container and limits access to the dispenser so that a user does not move the dispenser and discharge paint inadvertently when gripping the paint canister by the dispenser guard.

In a first illustrative embodiment, the dispenser-locator shoulder is a rim that continuously extends around the outer surface of the tapered container. In a second illustrative embodiment, the dispenser-locator shoulder is an interrupted rim including four tabs spaced around the outer surface of the tapered container.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
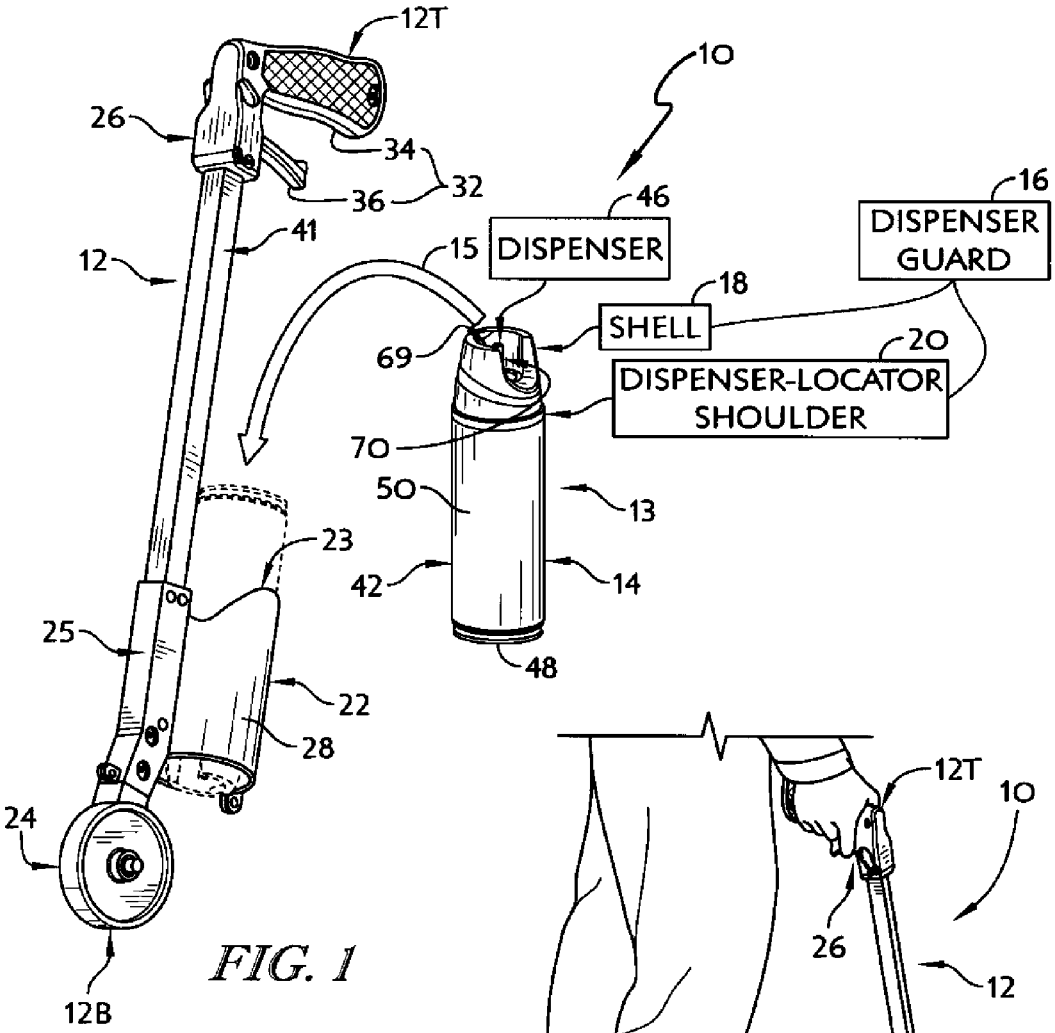
FIG. 1 is a perspective view of a marking wand for marking lines on the ground including a frame and a paint canister sized to be deposited in the frame, the paint canister including a downward-discharge spray can with a dispenser and a dispenser guard mounted permanently on the downward-discharge spray can to locate the dispenser relative to the frame when the paint canister is deposited in the frame.
Figure 2:
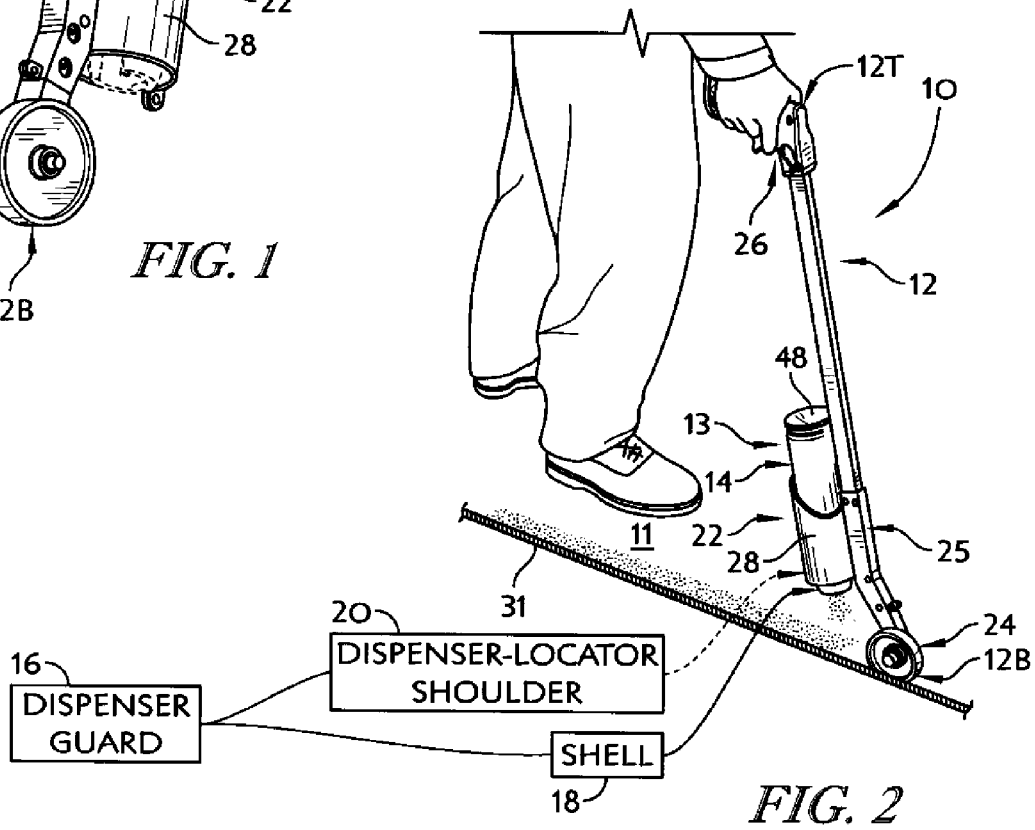
FIG. 2 is a perspective view of the marking wand of FIG. 1 showing that the frame includes a canister holder forming a chamber sized to receive the paint canister, an alignment wheel at the bottom end of the frame, and an actuation system including a handle with a trigger at the top end of the frame, and showing that the marking wand is used to discharge paint when a user pulls the trigger toward the handle to mark a line on the ground.

An illustrative marking wand 10, shown in FIG. 1, is used to mark lines of paint on the ground. Marking wand 10 includes a frame 12 and a paint canister 13 configured to be deposited into a chamber 23 at a bottom end 12B of frame 12 so that paint canister 13 is oriented in a downward direction as suggested by arrow 15 in FIG. 1. When paint canister 13 is deposited in frame 12, a user can hold a handle 32 at a top end 12T of frame 12 and pull a trigger 36 included in handle 32 to discharge paint from paint canister 13 and mark a line on the ground as shown in FIG. 2.

Figure 3:
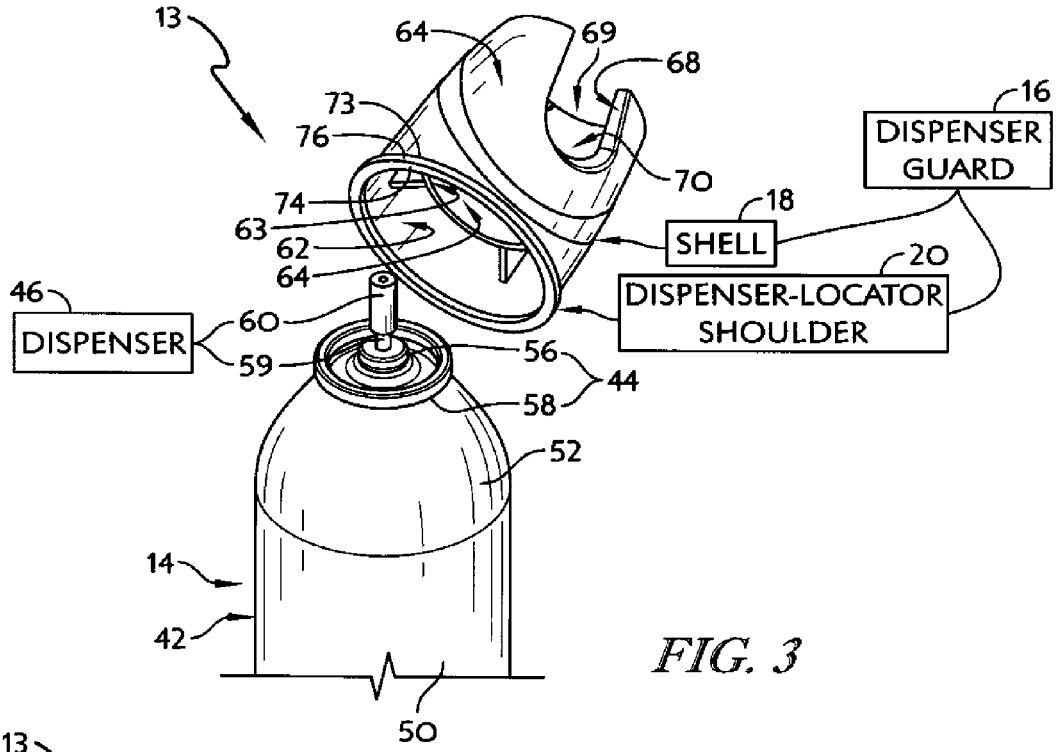
FIG. 3 is a partially exploded view of the paint canister of FIG. 1 before the dispenser guard is mounted on the downward-discharge spray can showing that the downward-discharge spray can includes a tapered container, a dispenser support coupled to the top of the tapered container, and the paint dispenser extending through the dispenser support to dispense paint stored in the tapered container.

Paint canister 13 includes a downward-discharge spray can 14 with a tapered container 42 for holding paint as shown in FIG. 3. Paint canister 13 also includes a dispenser guard 16 configured to mount permanently on downward-discharge spray can 14. Downward-discharge spray can 14 includes a dispenser 46 configured to discharge paint held by tapered container 42. Tapered container 42 is formed from a cylindrical side wall 50 and dome wall that tapers in from the side wall 50. Dispenser guard 16 of paint canister 13 is configured to contact frame 12 when paint canister 13 is deposited in frame 12 so that paint canister 13 is located properly relative to frame 12.

Figure 5:
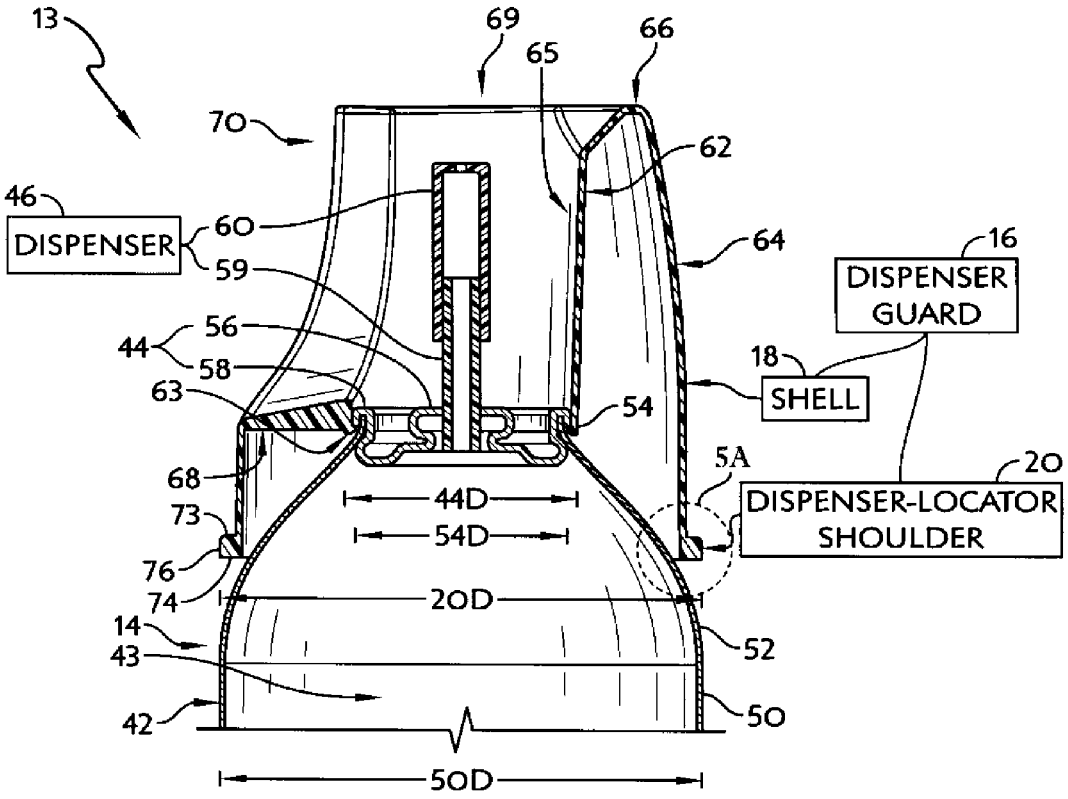
FIG. 5 is a cross-sectional view of the paint canister of FIG. 4 taken along line 5-5 showing that the shell of the dispenser guard includes an inner wall coupled to the dispenser support of the downward-discharge spray can and an outer wall spaced radially from the inner wall and supporting the dispenser-locator shoulder of the dispenser guard.
Figure 5A:
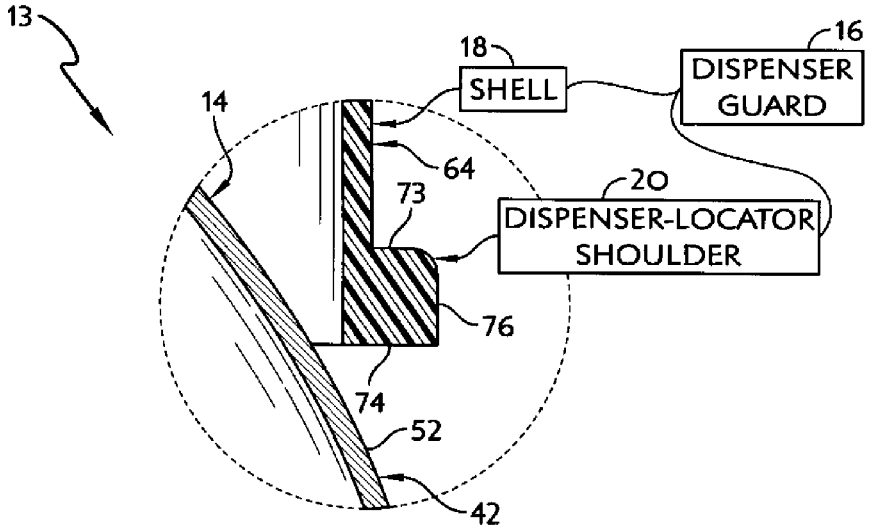
FIG. 5A is a detail cross-sectional view of the paint canister of FIG. 5 showing that the dispenser-locator shoulder of the dispenser guard is spaced apart from the tapered container of the downward-discharge spray can when the dispenser guard is mounted on the downward-discharge spray can.
Figure 6:
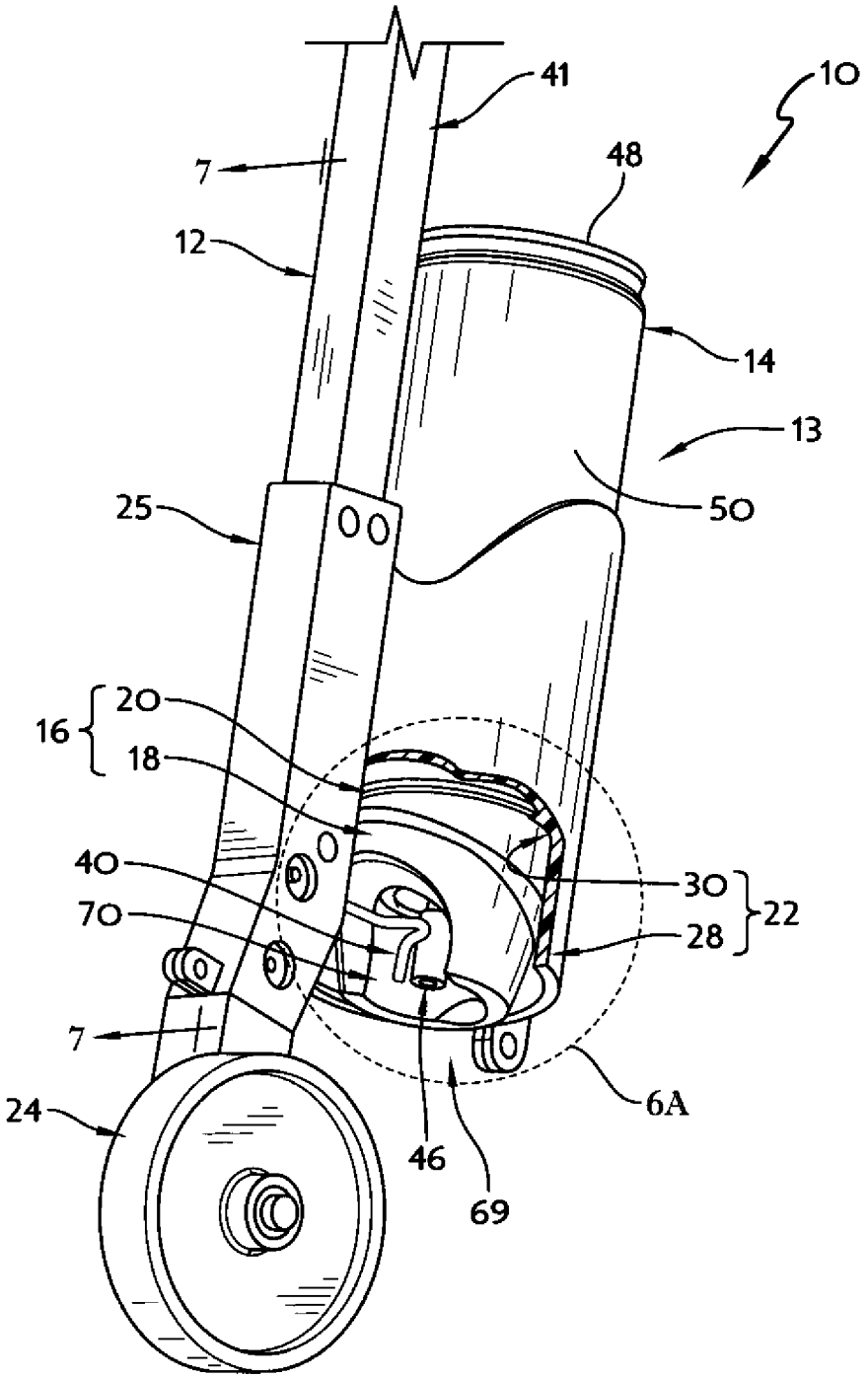
FIG. 6 is a partial perspective view of the marking wand of FIG. 1 in which a portion of the paint holder has been cut away to show that the actuation system of the frame includes an actuation finger extending into the chamber of the paint holder to engage the paint dispenser of the downward-discharge spray can and to show that the canister holder of the frame includes a cylindrical support wall and a support rib arranged to extend inwardly in the radial direction from the cylindrical support wall to block the dispenser guard from sliding through the chamber entirely past the support rib.
Figure 7:
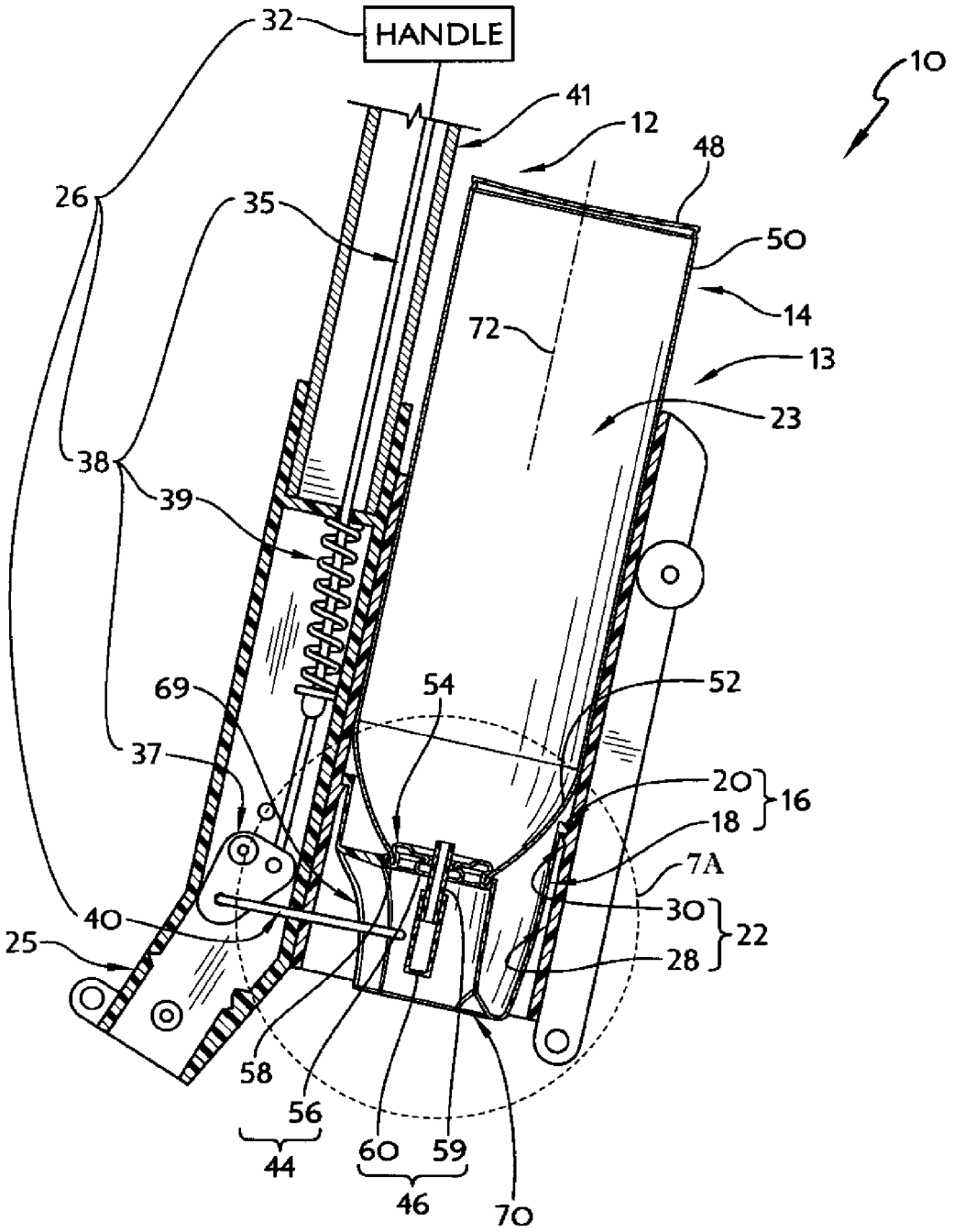
FIG. 7 is a cross sectional view of the marking wand of FIG. 6 taken at line 7-7 showing that the actuation finger of the actuation system extends through the side-actuation window formed in the shell of the dispenser guard when the paint canister is supported in the chamber of the frame.

Dispenser guard 16 includes a shell 18 and a dispenser-locator shoulder 20 that locates dispenser 46 of paint canister 13 in the chamber 23 of frame 12 as shown, for example, in FIGS. 6 and 7. Shell 18 is coupled permanently to downward-discharge spray can 14 and limits access to dispenser 46 so that a user does not move dispenser 46 and discharge paint inadvertently when gripping paint canister 13 by dispenser guard 16. Dispenser-locator shoulder 20 is spaced apart from an outer surface of tapered container 42 and is supported by shell 18 as shown, for example in FIGS. 5 and 5A.

Frame 12 includes a canister holder 22 forming chamber 23, an alignment wheel 24 located at bottom end 12B of frame 12, and an actuation system 26 including trigger 36 as shown, for example, in FIG. 1. Canister holder 22 is configured to support paint canister 13 when paint canister 13 is deposited in chamber 23. Canister holder 22 and alignment wheel 24 are coupled to a sleeve 25 included in frame 12 as shown in FIG. 1. Alignment wheel 24 is configured to roll along a surface 11 being marked by marking wand 10 as paint is discharged in a line on surface 11 as shown in FIG. 2. Actuation system 26 is configured to engage downward-discharge spray can 14 in response to a user pulling trigger 36 so that paint is dispensed from marking wand 10 as shown in FIG. 2.

Figure 6A:
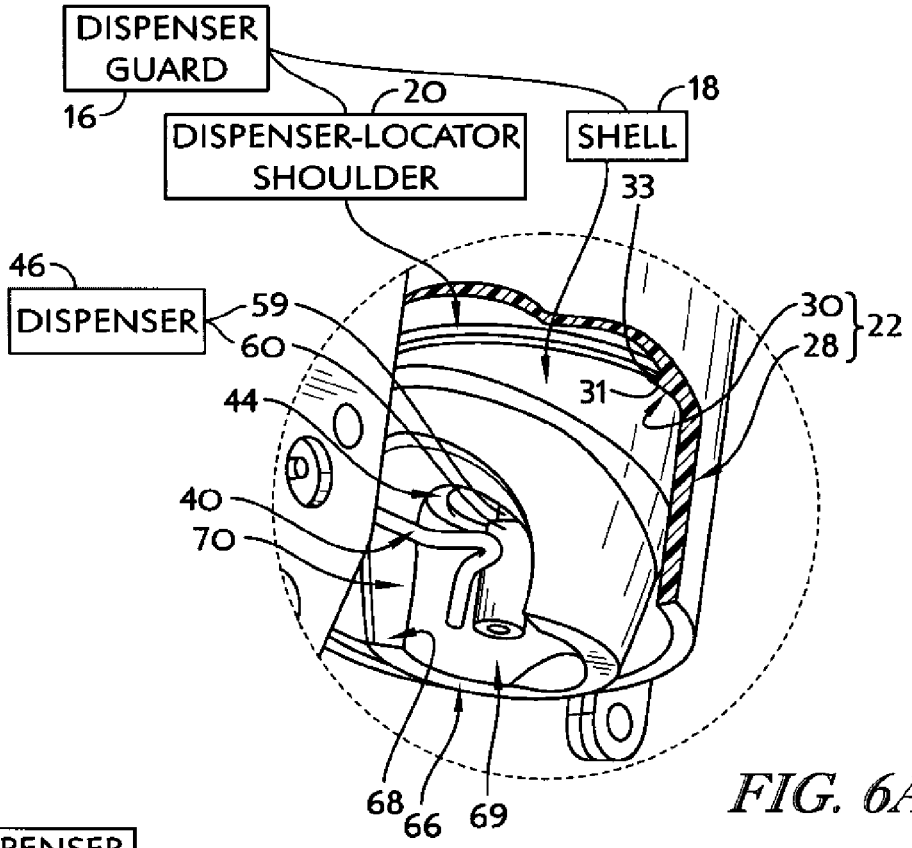
FIG. 6A is a detail view of the marking wand of FIG. 6 showing that the dispenser-locator shoulder of the dispenser guard contacts the support rib of the canister holder when the paint canister is deposited in the frame to block the paint canister from sliding through the chamber so that the actuation finger of the actuation system is positioned to engage the paint dispenser of the downward-discharge spray can at a predetermined location spaced apart from the dispenser support of the downward-discharge spray can.

Canister holder 22 includes a cylindrical support wall 28 and a support rib 30 extending inwardly from cylindrical support wall 28 as shown, for example, in cutaway FIGS. 6 and 6A. Cylindrical support wall 28 is coupled to sleeve 25 at bottom end 12B of frame 12 and forms chamber 23 sized to receive paint canister 13. Support rib 30 extends into chamber 23 and includes a side surface 31 and a stop surface 33 extending substantially perpendicularly from cylindrical support wall 28. Stop surface 33 of support rib 30 is configured to contact dispenser-locator shoulder 20 of dispenser guard 16 when paint canister 13 is deposited in chamber 23 of canister holder 22 to position downward-discharge spray can 14 relative to frame 12 during operation of marking wand 10.

Alignment wheel 24 can be guided by a user along a string 31 or some other marker to dispense paint along a predetermined path as shown, for example, in FIG. 2. In some embodiments, alignment wheel 24 may be removable from frame 12.

Actuation system 26 of frame 12 includes handle 32 with a grip 34 and trigger 36, a linkage 38, and an actuation finger 40 as shown in FIG. 7. Trigger 36 of handle 32 is pulled toward grip 34 of handle 32 to operate marking wand 10 so that marking wand 10 discharges paint. Linkage 38 couples trigger 36 to actuation finger 40 so that actuation finger 40 engages downward-discharge spray can 14 in response to a user pulling trigger 36 toward grip 34. Actuation finger 40 extends into chamber 23 of holder 22 through cylindrical support wall 28 and moves to engage downward-discharge spray can 14 as suggested by arrow 40A in response to a user pulling trigger 36 toward grip 34. Actuation finger 40 is spaced along cylindrical support wall 28 of canister holder 22 (about 1.5 inches) from support rib 30 in the illustrative embodiment.

Linkage 38 of actuation system 26 includes a cable 35, a pivot plate 37, and a spring 39 as shown in FIG. 7. Cable 35 is coupled to trigger 36 and to pivot plate 37. Cable 35 extends from handle 32 to sleeve 25 through an extension tube 41 included in frame 12. Pivot plate is coupled to actuation finger 40 and is configured to transfer motion from cable 35 to actuation finger 40. Pivot plate 37 is housed in and pivotally coupled to sleeve 25. Spring 39 is configured to bias actuation finger 40 away from engagement with downward-discharge spray can 14.

Downward-discharge spray can 14 includes tapered container 42, a dispenser support 44, and paint dispenser 46 as shown in FIG. 3. Tapered container 42 is formed from a single sheet of metal defining a bottom wall 48, side wall 50, dome wall 52, and aperture 54. Dispenser support 44 includes a pedestal 56 and an annular lip 58 coupled to tapered container 42 so that dispenser support 44 covers top aperture 54 of tapered container 42 as shown in FIG. 3. Paint dispenser 46 includes a stem 59 extending through dispenser support 44 and a nozzle 60 coupled to stem 59. Paint dispenser 46 is configured to discharge paint stored in downward-discharge spray can 14 when stem 59 and nozzle 60 are moved relative to dispenser support 44 by actuation finger 40 or by the finger of a user. In some embodiments, downward-discharge spray can 14 may be of the type manufactured by DS Containers of Batavia, Ill.

Side wall 50 of downward-discharge spray can 14 has a diameter 50D and dispenser support 44 has a diameter 44D as shown in FIG. 5. Diameter 50D of side wall 50 is larger than diameter 44D of dispenser support 44. Diameter 50D is about 2.5 inches and diameter 44D is about 1.3 inches in the illustrative embodiment. Dome wall 52 tapers in from side wall 50 and gradually decreases in diameter from side wall 50 to top aperture 54 forming a partial dome.

Figure 4:
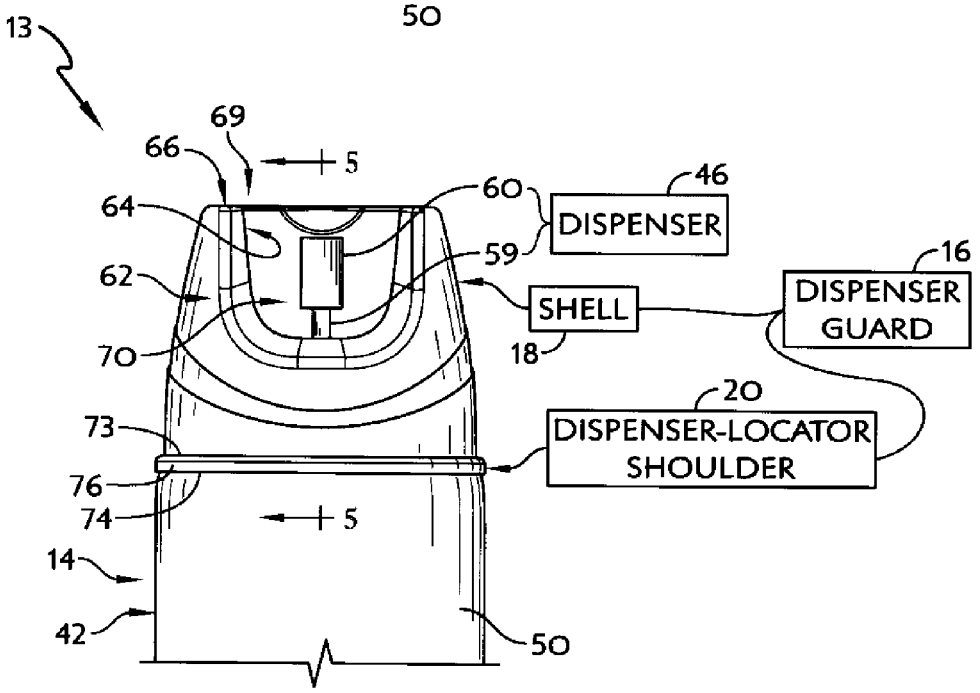
FIG. 4 is a side elevation view of the paint canister of FIG. 3 showing that the dispenser guard has been mounted on the downward-discharge spray can and showing that the dispenser guard includes a shell extending around the paint dispenser and a dispenser-locator shoulder extending out from the shell along the bottom edge of the shell and that the paint dispenser is accessible through a side-actuation window formed in the shell of the dispenser guard.

In illustrative embodiments, dispenser guard 16 is a unitary plastic component formed from shell 18 and dispenser-locator shoulder 20 arranged to extend outwardly from shell 18 as shown in FIG. 4. Shell 18 is configured to couple to dispenser support 44 of downward-discharge spray can 14 when dispenser guard 16 is mounted permanently on downward-discharge spray can 14 to form paint canister 13 as shown, for example, in FIG. 5. Dispenser-locator shoulder 20 is configured to contact support rib 30 of frame 12 to locate paint dispenser 46 of downward-discharge spray can 14 relative to actuation finger 40 of frame 12 when paint canister 13 is deposited in frame 12 as shown, for example, in FIGS. 6 and 6A.

Shell 18 extends around paint dispenser 46 and includes an inner wall 62, a mount ring 63, an outer wall 64, a connection wall 66, and an access wall 68 as shown, for example, in FIG. 5. Inner wall 62 is sized to mount to annular lip 58 of dispenser support 44. Mount ring 63 extends inwardly in the radial direction from the bottom edge of inner wall 62 to couple shell 18 to the downward-discharge spray can 14. Outer wall 64 is spaced apart from inner wall 62 and is spaced apart from tapered container 42 as shown in FIG. 5A. Connection wall 66 extends between inner wall 62 and outer wall 64 around an end-spray opening 69 formed in the top of shell 18. Access wall 68 extends between inner wall 62 and outer wall 64 along an side-actuation opening 70 formed in a side of shell 18. Inner wall 62, mount ring 63, connection wall 66, and access wall 68 cooperate to provide a guard mount 65 configured to support outer wall 64 and dispenser-locator shoulder 20 relative to downward-discharge spray can 14 as shown in FIG. 5.

Shell 18 forms end-spray opening 69 and side-actuation opening 70 as shown, for example, in FIG. 6A. End-spray opening 69 is located so that paint passes through dispenser guard 16 substantially along a longitudinal axis 72 of downward-discharge spray can 14 when paint is dispensed from downward-discharge spray can 14. Side-actuation opening 70 is located for actuation finger 40 (or a user's finger) to pass through dispenser guard 16 so that the actuation finger 40 can access paint dispenser 46 perpendicular to an axis 72 of downward-discharge spray can 14 as shown in FIG. 7. End-spray opening 69 communicates with side-actuation opening 70 in the illustrative embodiment. In other embodiments, end-spray opening 69 may be separated from side-actuation opening 70.

Figure 7A:
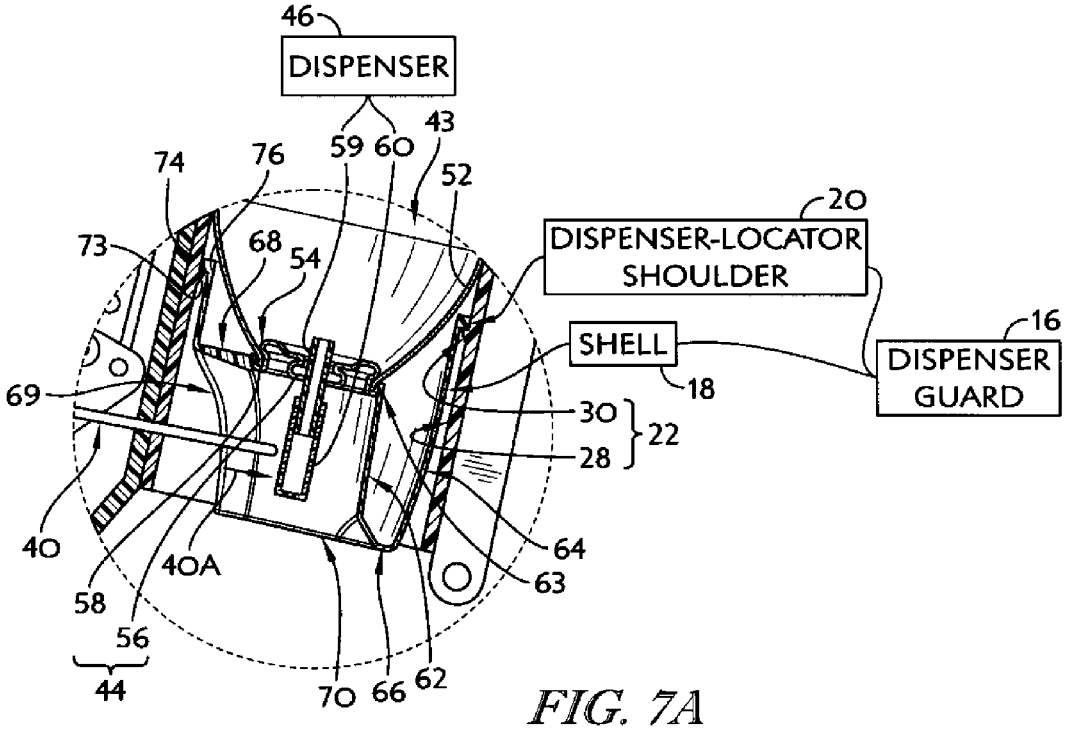
FIG. 7A is a detail cross-sectional view of the marking wand of FIG. 7 showing that the paint dispenser includes a stem extending through the dispenser support of the downward-discharge spray can and a nozzle configured to be engaged by the actuation finger of the frame.

Dispenser-locator shoulder 20 extends outwardly from outer wall 64 of shell 18 and is spaced apart from tapered container 42 as shown, for example, in FIGS. 7 and 7A. Dispenser-locator shoulder 20 of dispenser guard 16 is located along axis 72 of downward-discharge spray can 14 between dispenser support 44 of downward-discharge spray can 14 and bottom wall 48 of tapered container 42 included on downward-discharge spray can 14. Dispenser-locator shoulder 20 is further located between dispenser support 44 and side wall 50 of downward-discharge spray can 14 as shown in FIG. 7. In some embodiments, dispenser-locator shoulder 20 may be located along side wall 50 of downward-discharge spray can 14. Dispenser-locator shoulder 20 is sized to be received in chamber 23 of canister holder 22.

Dispenser-locator shoulder 20 is formed to include a top surface 73, a bottom surface 74, and an outer surface 76 as shown in FIG. 5A. Top surface 73 of dispenser-locator shoulder 20 is configured to contact stop surface 33 of support rib 30 extending in from cylindrical support wall 28 when paint canister 13 is deposited in canister holder 22 of frame 12. Bottom surface 74 of dispenser-locator shoulder 20 is configured to extend away from tapered container 42 of downward-discharge spray can 14 and may prevent downward-discharge spray can 14 from slipping through the fingers of a user holding downward-discharge spray can 14 in the upright position while dispenser guard 16 is mounted on downward-discharge spray can 14. In illustrative embodiments, outer surface 76 of dispenser-locator shoulder 20 has a diameter 20D that is larger than diameter 44D of dispenser support 44 and smaller than diameter 50D of side wall 50 included in tapered container 42.

Figure 7B:
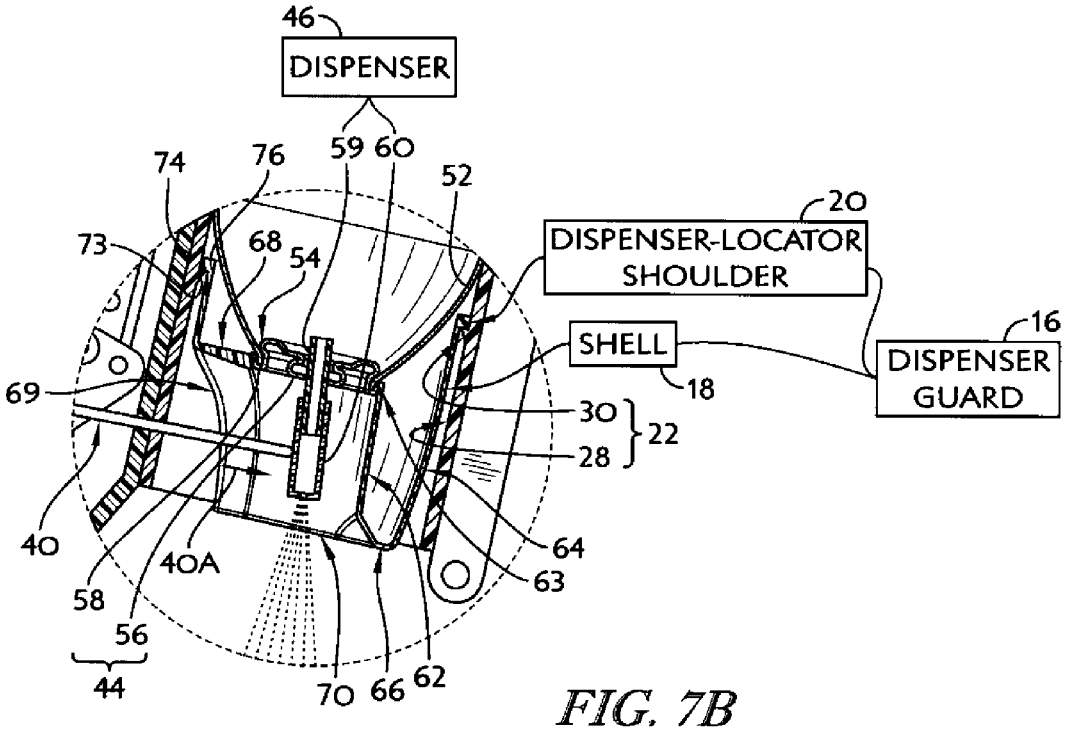
FIG. 7B is a view similar to FIG. 7A showing the actuation finger engaging the nozzle to move the dispenser from the closed position to the opened position so that paint is discharged through the dispenser.

When downward-discharge spray can 14 is located relative to frame 12 properly by dispenser-locator shoulder 20, actuation finger 40 of frame 12 is positioned to move through side-actuation opening 70 formed in dispenser guard 16 and engage nozzle 60 of paint dispenser 46 included in downward-discharge spray can 14 at a predetermined position spaced apart from dispenser support 44 of downward-discharge spray can 14 as shown, for example, in FIG. 7B. Actuation finger 40 of frame 12 moves to engage nozzle 60 of downward-discharge spray can 14 in response to a user pulling trigger 36 of frame 12 toward grip 34 of frame 12. When actuation finger 40 of frame 12 engages nozzle 60 of downward-discharge spray can 14, paint is discharged from downward-discharge spray can 14.

Figure 6B:
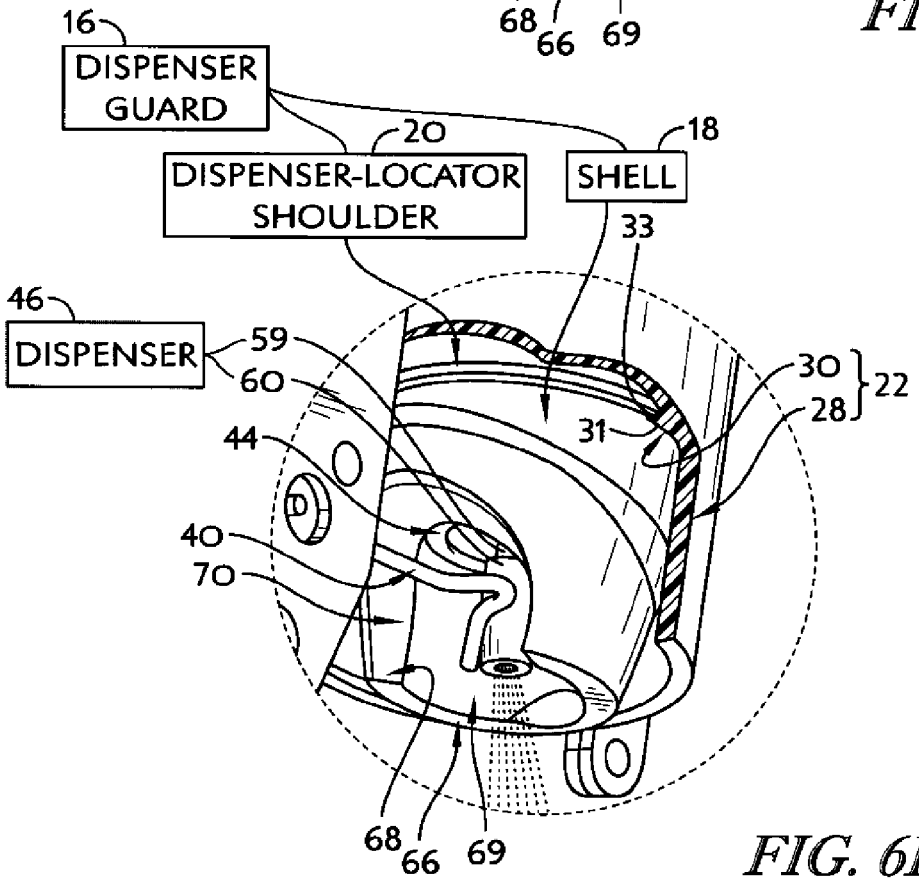
FIG. 6B is a view similar to FIG. 6A showing the actuation finger engaging the dispenser in the predetermined location to move the dispenser from a closed position to an opened position so that paint is discharged through the dispenser.

In certain embodiments, paint canister 13 may include downward-discharge spray can 14 and dispenser guard 16 as shown in FIG. 3. Downward-discharge spray can 14 illustratively includes container 42 and dispenser 46. Container 42 may be formed to include an interior paint-storage region 43 and aperture 54 opening into interior paint-storage region 43. Dispenser 46 may be coupled to container 42 and may be arranged to move from a closed position, shown in FIG. 6A, to an opened position, shown in FIG. 6B. When dispenser 46 is in the closed position, paint may be blocked from being discharged from interior paint-storage region 43 through the dispenser 46. When dispenser 46 is in the opened position, paint may be discharged from interior paint-storage region 43 through the dispenser 46. Dispenser guard 16 illustratively includes shell 18 and dispenser-locator means. Shell 18 may be mounted permanently to container 42 and may be arranged to extend around a portion of dispenser 46 to define end-spray opening 69 located in a plane spaced apart from container 42 and side-actuation opening 70. Dispenser-locator means may be adapted for positioning the dispenser 46 relative to actuation finger 40 of frame 12 arranged to extend through side-actuation opening 70 to apply a finger force to dispenser 46 in response to a user pulling trigger 36 included in frame 14 so that dispenser 46 is contacted at a predetermined position by actuation finger 40 to move dispenser 46 from the closed position to the opened position thereby causing paint to discharge from interior paint-storage region 43 of container 42 to the surroundings. Dispenser 46 may be arranged to discharge paint from interior paint-storage region 43 to the surroundings through end-spray opening 69 as shown in FIGS. 6B and 7B.

Shell 18 may include guard mount 65 with a bottom edge coupled to the container 42 and outer wall 64 coupled to guard mount 65 with a bottom edge spaced apart from container 42. The dispenser-locator means may include dispenser-locator shoulder 20. Dispenser-locator shoulder 20 may be arranged to extend outwardly in a radial direction from the bottom edge of the outer wall 64.

Container 42 may be a monolithic component and may include side wall 50 and dome wall 52 as shown in FIG. 5. Dome wall 52 may have a convex outer surface extending from side wall 50 as shown in FIG. 5. Dispenser-locator shoulder 20 may be arranged to extend around a portion of dome wall 52 as shown in FIGS. 5, 7, 7A, and 7B.

Dome wall 52 may be formed to include aperture 54 opening into interior paint-storage region 43 of container 42 as shown in FIG. 5. Dispenser-locator shoulder 20 may be located in the axial direction between side wall 50 and aperture 54.

Dispenser 46 may include nozzle 60 located outside of container 42 and stem 59 with a first end coupled to nozzle 60 outside of container 42 and a second end located inside interior paint-storage region 43 as shown in FIGS. 7A and 7B. The second end of stem 59 may be located inwardly in the radial direction from dome wall 52 of container 42 so that dispenser 46 is adapted to discharge paint from interior paint-storage region 43 of container 42 when dome wall 52 is positioned below side wall 50 and the level of paint in interior paint-storage region 43 is low.

Dispenser-locator shoulder 20 has shoulder diameter 20D as shown in FIG. 5. Cylindrical wall has wall diameter 50D. Shoulder diameter 20D is less than wall diameter 50D as shown in FIG. 5. Aperture 54 has an aperture diameter 54D and aperture diameter 54D is less than shoulder diameter 20D. In other embodiments, shoulder diameter 20D may be equal to or greater than wall diameter 50D.

Downward-discharge spray can 14 may include dispenser support 44 coupled to container 42 along an edge of aperture 54 as shown in FIG. 3. Dispenser support 44 may be arranged to cover aperture 54. Dispenser 46 may be coupled to dispenser support 44.

Guard mount 65 may include inner wall 62 arranged to extend around end-spray opening 69, connection wall 66 arranged to extend from inner wall 62 to outer wall 64, and mount ring 63 arranged to extend inwardly in the radial direction from a bottom edge of inner wall 62 as shown in FIG. 5. Mount ring 63 may be located between dispenser support 44 and container 42 to permanently mount dispenser guard 16 to downward-discharge spray can 14.

In some embodiments, paint canister 13 may include downward-discharge spray can 14, shell 18, and dispenser-locator shoulder 20 as shown in FIG. 3. Downward-discharge spray can 14 may include container 42 and dispenser 46. Container 42 may be formed to include interior paint-storage region 43 and aperture 54 opening into interior paint-storage region 43. Dispenser 46 may be coupled to container 42 and may be arranged to move from a closed position to an opened position. When dispenser 46 is in the closed position, paint is blocked from being discharged from interior paint-storage region 43 through dispenser 46. When dispenser 46 is in the opened position, paint is discharged from interior paint-storage region 43 through dispenser 46. Shell 18 may include inner wall 62 mounted permanently to container 42, connection wall 66 arranged to extend outwardly in a radial direction from inner wall 62, and outer wall 64 arranged to extend from connection wall 66 along inner wall 62 in spaced-apart relation to inner wall 62. Dispenser-locator shoulder 20 may be spaced apart from container 42 and may be arranged to extend outwardly in a radial direction from a bottom edge of outer wall 64. Inner wall 62 may be formed to define end-spray opening 69 located in a plane spaced apart from container 42. Inner wall 62 and outer wall 64 may cooperate to define a side-actuation opening 70. Dispenser 46 may be is arranged to discharge paint from interior paint-storage region 43 to the surroundings through end-spray opening 69 as shown in FIGS. 6B and 7B.

Container 42 may be a monolithic component and may include side wall 50 and dome wall 52 as shown in FIGS. 3 and 5. Dome wall 52 may have a convex outer surface arranged to extend from side wall 50. Dispenser-locator shoulder 20 may be arranged to extend around a portion of dome wall 52.

Dome wall 52 may be formed to include aperture 54 opening into interior paint-storage region 43 of container 42 as shown in FIG. 5. Dispenser-locator shoulder 20 may be located in an axial direction between side wall 50 and aperture 54.

Dispenser 46 may include nozzle 60 and stem 59 as shown in FIG. 5. Nozzle 60 may be located outside of container 42. Stem 59 may have a first end coupled to nozzle 60 outside of container 42 and a second end located inside interior paint-storage region 43 inwardly in the radial direction from dome wall 52 of container 42.

Dispenser-locator shoulder 20 has shoulder diameter 20D. Cylindrical wall has wall diameter 50D. Shoulder diameter 20D is less than wall diameter 50D as shown in FIG. 5. Aperture 54 has an aperture diameter 54D and aperture diameter 54D is less than shoulder diameter 20D. In other embodiments, shoulder diameter 20D may be equal to or greater than wall diameter 50D.

Downward-discharge spray can 14 may include dispenser support 44 coupled to container 42 along an edge of aperture 54 as shown in FIG. 5. Dispenser support 44 may be arranged to cover aperture 54. Dispenser 46 may be coupled to dispenser support 44.

Shell 18 may include mount ring 63 arranged to extend inwardly in the radial direction from a bottom edge of inner wall 62 as shown in FIG. 5. Mount ring 63 may be located between dispenser support 44 and container 42 to mount shell 18 to downward-discharge spray can 14.

Container 42 may be made from a metal and may be a monolithic component as suggested in FIGS. 3 and 5. Shell 18 and dispenser-locator shoulder 20 may be made from a plastics material and may cooperate to form a monolithic dispenser guard 16 as suggested in FIG. 3.

Figure 8:
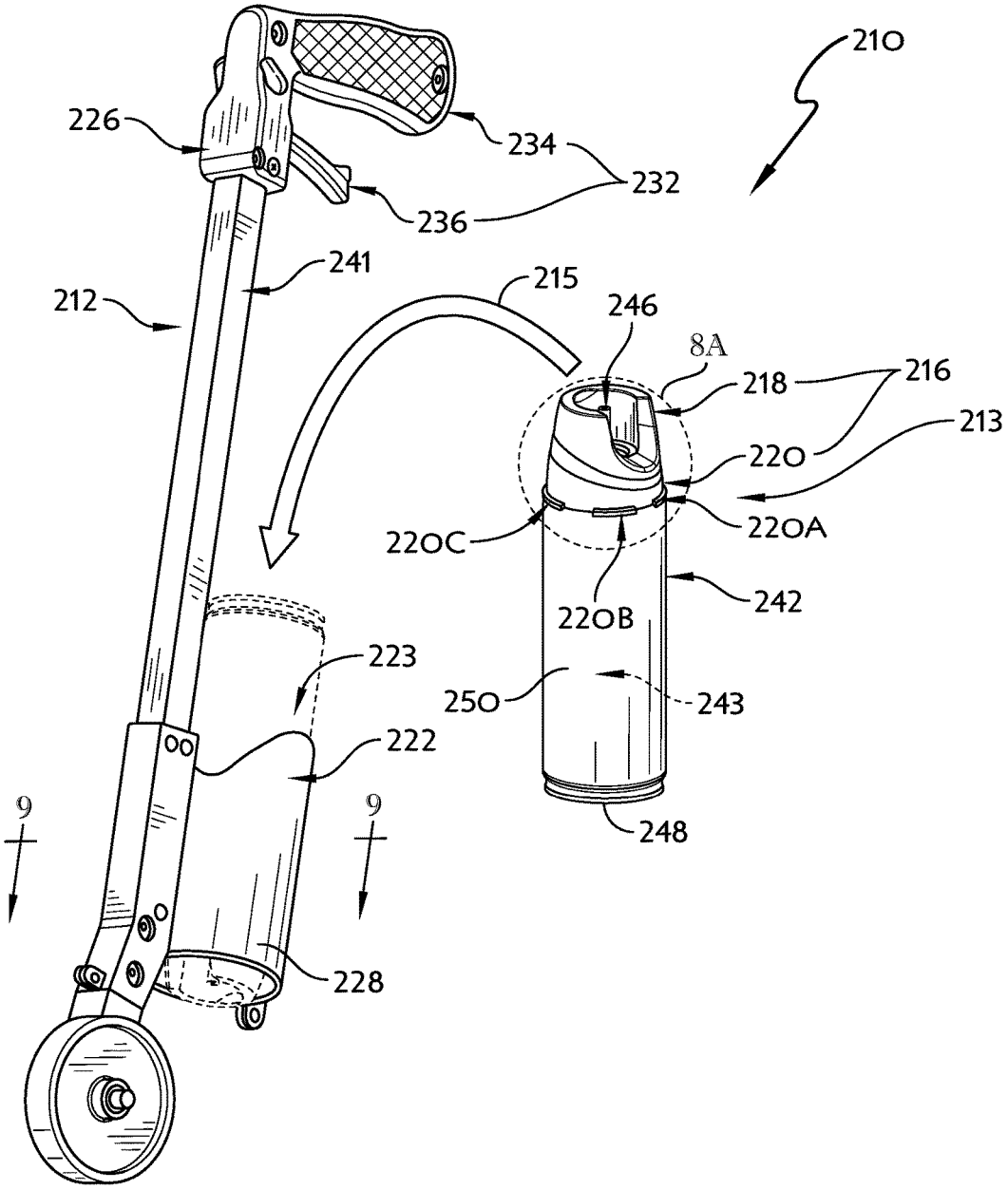
FIG. 8 is a perspective view of another marking wand including a frame and a paint canister sized to be deposited in the frame, the paint canister including an dispenser guard having an interrupted dispenser-locator shoulder for locating the paint canister relative to the frame when the paint canister is deposited in the frame.
Figure 8A:
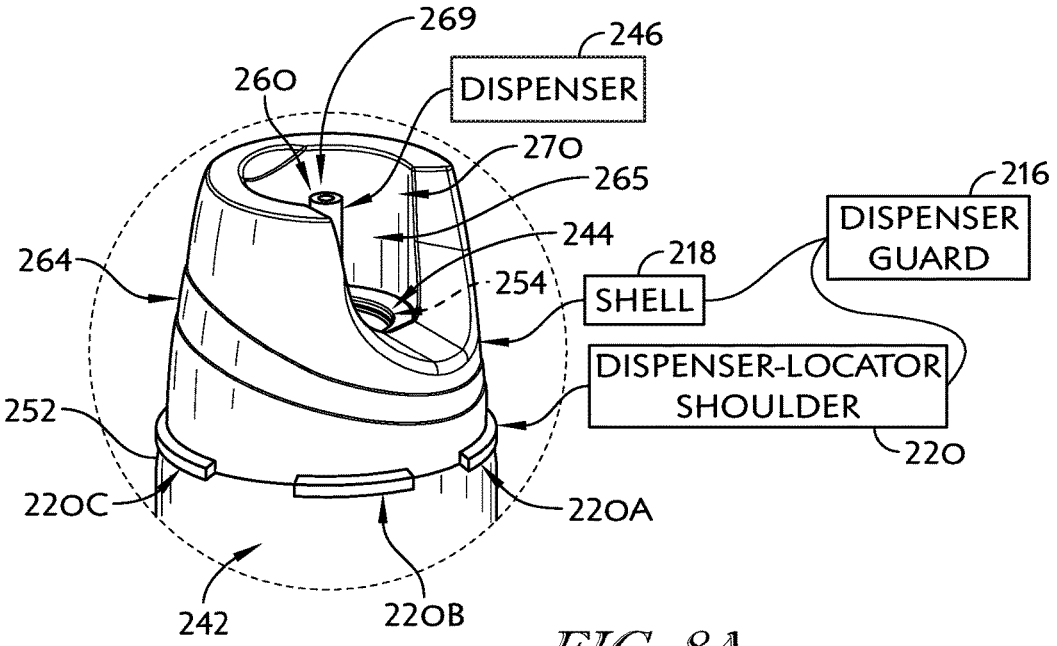
FIG. 8A is a detailed perspective view of the paint canister of FIG. 8 showing that that interrupted dispenser-locator shoulder of the dispenser guard includes a number of tabs spaced apart from one another around the bottom end of the shell, each tab extending outwardly from the bottom of the shell.
Figure 9:
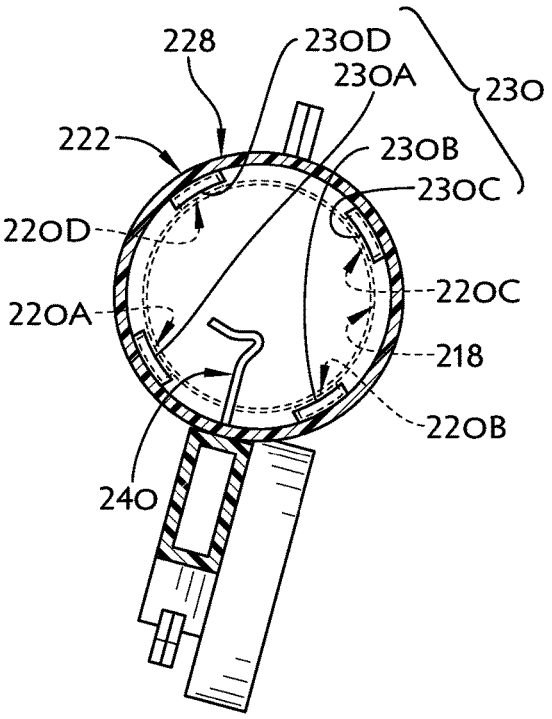
FIG. 9 is a cross-sectional view of the marking wand of FIG. 8 taken at line 9-9 showing that the support rib arranged to extend inwardly from the cylindrical support wall of the canister holder is interrupted and includes a number of support tabs and showing that the locating tabs of the dispenser guard are configured to contact the support tabs of the canister holder when the paint canister is deposited in the chamber of the canister holder.

Another illustrative marking wand 210 is shown in FIGS. 8, 8A, and 9. Marking wand 210 includes frame 212 and paint canister 213 sized to be deposited in frame 212. Paint canister 213 includes a downward-discharge spray can 214 and an dispenser guard 216 configured to be mounted permanently on downward-discharge spray can 214. Frame 212 includes a chamber 223 sized to receive paint canister 213 when paint canister 213 is deposited in frame 212 as suggested by arrow 215. Dispenser guard 216 includes a shell 218 and an interrupted dispenser-locator shoulder 220 configured to locate a dispenser 246 included in paint canister 213 properly relative to frame 212 for marking lines on the ground.

Frame 212, downward-discharge spray can 214, and shell 218 of dispenser guard 216 included in marking wand 210 are substantially similar in structure and operation to frame 12, downward-discharge spray can 14, and shell 18 of dispenser guard 16 included in marking wand 10. Therefore, similar reference numerals in the 200 series have been used denote like features and the discussion of marking wand 10 is hereby incorporated by reference into the description of marking wand 210.

Frame 212 includes a canister holder 222 and an actuation system 226. Canister holder 222 includes a cylindrical support wall 228 forming chamber 223 and a support rib 230 extending into chamber 223 as shown, for example, in FIGS. 8 and 9. Support rib 230 is interrupted and includes four support tabs 230A, 230B, 230C, 230D spaced around cylindrical support wall 228. Support tabs 230A, 230B, 230C, 230D extend inwardly from cylindrical support wall 228 and contact interrupted dispenser-locator shoulder 220 of dispenser guard 216 when paint canister 213 is deposited in chamber 223 of frame 212.

Actuation system 226 of marking wand 212 includes a handle 232 and an actuation finger 240. Handle 232 includes a grip 234 and a trigger 236. Trigger 236 of handle 232 is pulled toward grip 234 of handle 232 to operate spray paint marking system 210 so that marking wand 210 discharges paint. Actuation finger 240 extends into chamber 223 of frame 212 through cylindrical support wall 228 of canister holder 222 and moves to engage downward-discharge spray can 214 in response to a user pulling trigger 236 toward grip 234, thereby operating marking wand 210.

Downward-discharge spray can 214 includes a tapered container 242, a dispenser support 244, and paint dispenser 246 as shown in FIG. 8. Tapered container 242 is formed from a single sheet of metal defining a bottom wall 248, a side wall 250, and a dome wall 252.

In illustrative embodiments, dispenser guard 216 is a unitary plastic component formed from shell 218 and interrupted dispenser-locator shoulder 220. Dispenser-locator shoulder 220 extends in an outward direction from shell 218 as shown, for example, in FIG. 8A. Shell 218 is configured to couple to dispenser support 244 of downward-discharge spray can 214 when dispenser guard 216 is mounted permanently on downward-discharge spray can 214 to form paint canister 213. Interrupted dispenser-locator shoulder 220 is configured to contact support rib 230 of marking wand 212 to locate paint dispenser 246 of downward-discharge spray can 214 relative to actuation finger 240 of marking wand 212 when paint canister 213 is received in marking wand 212.

Interrupted dispenser-locator shoulder 220 extends in an outward direction from an outer wall 264 of shell 218 and includes four rim tabs 220A, 220B, 220C, 220D spaced around shell 218 as shown, for example, in FIG. 8A. Rim tabs 220A, 220B, 220C, 220D are spaced apart from tapered container 242.

Interrupted dispenser-locator shoulder 220 is configured to align with support rib 230 when paint canister 213 is received in canister holder 222 such that actuation finger 240 extends through an side-actuation opening 270 formed in dispenser guard 216 as shown, for example, in FIG. 9. Specifically, when paint canister 213 is deposited in chamber 223, rim tab 220A contacts support tab 230A, rim tab 220B contacts support tab 230B, rim tab 220C contacts support tab 230C, and rim tab 220D contacts support tab 230D. In other embodiments, a single rim tab may contact one or more support tabs or more than one rim tab may contact a single support tab. The tab, tabs, or continuous rim locate the paint canister 213 in the frame 212 at a height so that the actuation finger 240 contacts the nozzle 260 of paint canister 213 at a predetermined position.

When paint canister 213 is located properly relative to frame 212 by interrupted dispenser-locator shoulder 220, actuation finger 240 of frame 212 is positioned to move through an side-actuation opening 270 formed in dispenser guard 216 and engage paint dispenser 246 included in downward-discharge spray can 214 at a predetermined position spaced apart from dispenser support 244 of downward-discharge spray can 214. Actuation finger 240 of marking wand 212 moves to engage nozzle 260 of downward-discharge spray can 214 in response to a user pulling trigger 236 of marking wand 212 toward grip 238 of marking wand 212. When actuation finger 240 of marking wand 212 engages nozzle 60 of downward-discharge spray can 214, paint is discharged from downward-discharge spray can 214 to mark a line on the ground.

In certain embodiments, paint canister 213 may include downward-discharge spray can 214 and dispenser guard 216 as shown in FIG. 8. Downward-discharge spray can 214 illustratively includes container 242 and dispenser 246. Container 242 may be formed to include an interior paint-storage region 243 and aperture 254 opening into interior paint-storage region 243. Dispenser 246 may be coupled to container 242 and may be arranged to move from a closed position to an opened position. When dispenser 246 is in the closed position, paint may be blocked from being discharged from interior paint-storage region 243 through the dispenser 246. When dispenser 246 is in the opened position, paint may be discharged from interior paint-storage region 43 through the dispenser 246. Dispenser guard 216 illustratively includes shell 218 and dispenser-locator means. Shell 218 may be mounted permanently to container 242 and may be arranged to extend around a portion of dispenser 246 to define end-spray opening 269 located in a plane spaced apart from container 242 and side-actuation opening 270. Dispenser-locator means may be adapted for positioning the dispenser 246 relative to actuation finger 240 of frame 212 arranged to extend through side-actuation opening 270 to apply a finger force to dispenser 246 in response to a user pulling trigger 236 included in frame 214 so that dispenser 246 is contacted at a predetermined position by actuation finger 240 to move dispenser 246 from the closed position to the opened position thereby causing paint to discharge from interior paint-storage region 243 of container 242 to the surroundings. Dispenser 246 may be arranged to discharge paint from interior paint-storage region 243 to the surroundings through end-spray opening 269.

Shell 218 may include guard mount 265 with a bottom edge coupled to the container 242 and outer wall 264 coupled to guard mount 265 with a bottom edge spaced apart from container 242 as shown in FIGS. 8 and 9. The dispenser-locator means may include dispenser-locator shoulder 220. Dispenser-locator shoulder 220 may be arranged to extend outwardly in a radial direction from the bottom edge of the outer wall 264.

Dispenser-locator shoulder 220 may be interrupted as shown in FIGS. 8, 8A, and 9. In some such embodiments, dispenser-locator shoulder 220 may include rim tabs 220A, 220B, 220C, 220D arranged to extend around portion of the outer wall, each of the plurality of rim tabs having a rectangular cross section.

The invention claimed is:

1. A paint canister comprising a downward-discharge spray can including a container formed to include an interior paint-storage region and an aperture opening into the interior paint-storage region and a dispenser coupled to the container and arranged to move from a closed position in which paint is blocked from being discharged from the interior paint-storage region through the dispenser to an opened position in which paint is discharged from the interior paint-storage region through the dispenser in response to a force being applied to a side of the dispenser, and a dispenser guard including a shell mounted permanently to the container and arranged to extend around a portion of the dispenser to define an end-spray opening located in a plane spaced apart from the container and a side-actuation opening and dispenser-locator means for positioning the dispenser relative to an actuation finger included in a frame arranged to extend through the side-actuation opening to apply a finger force to a nozzle of the dispenser in response to pulling a trigger included in the frame so that the dispenser is contacted at a predetermined position by the actuation finger to move the dispenser from the closed position to the opened position thereby causing paint to discharge from the interior paint-storage region of the container to the surroundings, wherein the dispenser is arranged to discharge paint from the interior paint-storage region to the surroundings through the end-spray opening, the shell includes a mount ring configured to couple the dispenser guard to the container such that the dispenser guard is spaced apart from the nozzle of the dispenser, an inner wall coupled to the mount ring and extending away from the container, a connection wall coupled to the inner wall and extending at least partially around a circumference of the inner wall, an access wall coupled to the inner wall and extending at least partially around the circumference of the inner wall, and an outer wall coupled to the connection wall and access wall and extending toward the container with a bottom edge of the outer wall spaced apart from the container, the dispenser-locator means includes a dispenser-locator shoulder arranged to extend outwardly in a radial direction from the bottom edge of the outer wall, the dispenser-locator shoulder is interrupted and includes a plurality of rim tabs arranged to extend around a portion of the outer wall forming an arcuate shape when viewed from above and each rim tab arranged to engage a single corresponding support tab of a plurality of support tabs included in the frame to block axial movement of the dispenser guard in at least on direction and allow rotation of the dispenser guard, at least a portion of the access wall is substantially axially aligned with the mount ring, and the actuation finger is configured to engage with portions of the shell defining the side-actuation opening to block disengagement of the rim tabs from the corresponding support tabs through rotation of the dispenser guard.

2. The paint canister of claim 1, wherein the container is a monolithic component and includes a cylindrical wall and a dome wall with a convex outer surface extending from the cylindrical wall, and the dispenser-locator shoulder is arranged to extend around a portion of the dome wall.

3. The paint canister of claim 2, wherein the dome wall is formed to include the aperture opening into the interior paint-storage region of the container and the dispenser-locator shoulder is located in the axial direction between the cylindrical wall and the aperture.

4. The paint canister of claim 2, wherein the dispenser includes the nozzle located outside of the container and a stem with a first end coupled to the nozzle outside of the container and a second end located inside the interior paint-storage region.

5. The paint canister of claim 4, wherein the second end of the stem is located inwardly in the radial direction from the dome wall of the container so that the dispenser is adapted to discharge paint from the interior paint-storage region of the container when the dome wall is positioned below the cylindrical wall and the level of paint in the interior paint-storage region is low.

6. The paint canister of claim 2, wherein the dispenser-locator shoulder has a shoulder diameter, the cylindrical wall has a wall diameter, and the shoulder diameter is less than the wall diameter.

7. The paint canister of claim 6, wherein the aperture has an aperture diameter and the aperture diameter is less than the shoulder diameter.

8. The paint canister of claim 1, wherein the downward-discharge spray can includes a dispenser support coupled to the container along an edge of the aperture and arranged to cover the aperture, and the dispenser is coupled to the dispenser support.

9. The paint canister of claim 8, wherein the inner wall is arranged to extend around the end-spray opening, the connection wall is arranged to extend from the inner wall to the outer wall, and the mount ring is arranged to extend inwardly in the radial direction from a bottom edge of the inner wall, the mount ring located between the dispenser support and the container to permanently mount the dispenser guard to the downward-discharge spray can.

10. The paint canister of claim 1, wherein each of the plurality of rim tabs having a rectangular cross section.

11. The paint canister of claim 1, wherein the downward-discharge spray can includes a dispenser support coupled to the container along an edge of the aperture and arranged to cover the aperture, and the dispenser is coupled to the dispenser support.

12. The paint canister of claim 11, wherein the mount ring is arranged to extend inwardly in the radial direction from a bottom edge of the inner wall, the mount ring located between the dispenser support and the container to mount the shell to the downward-discharge spray can.

13. The paint canister of claim 1, wherein the container is made from a metal and is a monolithic component, and the shell and the dispenser-locator shoulder are made from a plastics material and cooperate to form a monolithic dispenser guard.

14. A paint canister comprising a downward-discharge spray can including a container formed to include an interior paint-storage region and an aperture opening into the interior paint-storage region and a dispenser coupled to the container and arranged to move from a closed position in which paint is blocked from being discharged from the interior paint-storage region through the dispenser to an opened position in which paint is discharged from the interior paint-storage region through the dispenser in response to a force being applied to a side of the dispenser, a dispenser guard including a shell and a dispenser-locator shoulder, the shell including a guard mount coupled to the container such that the dispenser guard is spaced apart from a nozzle of the dispenser and an outer wall coupled to the guard mount, and the dispenser-locator shoulder arranged to extend outwardly in a radial direction from the outer wall, wherein the dispenser-locator shoulder is configured to position the dispenser relative to an actuation finger included in a frame when the paint canister is received in the frame, wherein the dispenser-locator shoulder includes a plurality of rim tabs each arranged to extend around a portion of the outer wall, wherein the shell includes a mount ring configured to couple the dispenser guard to the container, an inner wall coupled to the mount ring and extending away from the container, a connection wall coupled to the inner wall and extending at least partially around a circumference of the inner wall, and an access wall coupled to the inner wall and extending at least partially around the circumference of the inner wall, the outer wall is coupled to the connecting wall and the access wall and extends towards the container, and wherein at least a portion of the access wall is substantially axially aligned with the mount ring.

15. The paint canister of claim 14, wherein each rim tab is arranged to contact a single corresponding support tab included in a canister holder when the paint canister is received in the canister holder.

16. A paint canister comprising a downward-discharge spray can including a container formed to include an interior paint-storage region and an aperture opening into the interior paint-storage region and a dispenser coupled to the container and arranged to move from a closed position in which paint is blocked from being discharged from the interior paint-storage region through the dispenser to an opened position in which paint is discharged from the interior paint-storage region through the dispenser in response to a force being applied to a side of the dispenser, and a dispenser guard including a shell and a dispenser-locator shoulder, the shell including a mount ring configured to couple the dispenser guard to the container such that the dispenser guard is spaced apart from the nozzle of the dispenser, an inner wall coupled to the mount ring and extending away from the container, a connection wall coupled to the inner wall and extending at least partially around a circumference of the inner wall, an access wall coupled to the inner wall and extending at least partially around the circumference of the inner wall, and an outer wall coupled to the connection wall and access wall and extending toward the container, and the dispenser-locator shoulder arranged to extend outwardly in a radial direction from the outer wall, wherein the dispenser-locator shoulder is configured to position the dispenser relative to an actuation finger included in a frame when the paint canister is received in the frame and includes a plurality of rim tabs, the plurality of rim tabs are each arranged to extend around a portion of the outer wall, the plurality of rim tabs are each arranged to align with a single corresponding support tab of a plurality of support tabs included in the frame when the paint canister is received in the frame such that the paint canister is oriented in a predetermined orientation relative to the frame, and at least a portion of the access wall is substantially axially aligned with the mount ring.

* * * * *